US008103515B2

(12) United States Patent
Chen et al.

(10) Patent No.: US 8,103,515 B2
(45) Date of Patent: Jan. 24, 2012

(54) SIGNAL CLASSIFICATION PROCESSING METHOD, CLASSIFICATION PROCESSING DEVICE, AND ENCODING SYSTEM

(75) Inventors: Longyin Chen, Shenzhen (CN); Zexin Liu, Beijing (CN); Lei Miao, Beijing (CN); Chen Hu, Shenzhen (CN); Wei Xiao, Shenzhen (CN); Marcel Taddei Herve, Voorburg (NL); Qing Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/160,115

(22) Filed: Jun. 14, 2011

(65) Prior Publication Data

US 2011/0238427 A1 Sep. 29, 2011

Related U.S. Application Data

(63) Continuation of application No. PCT/CN2009/075243, filed on Dec. 1, 2009.

(30) Foreign Application Priority Data

Dec. 23, 2008 (CN) ..... 2008 1 0187911

(51) Int. Cl.
*G10L 19/00* (2006.01)

(52) U.S. Cl. ..... 704/500

(58) Field of Classification Search ..... 704/500
See application file for complete search history.

(56) References Cited

U.S. PATENT DOCUMENTS 5,394,473 A 2/1995 Davidson
6,266,644 B1 7/2001 Levine
6,581,032 B1 6/2003 Gao et al.
7,249,015 B2 7/2007 Jiang et al.
7,328,149 B2 2/2008 Jiang et al.
(Continued)

FOREIGN PATENT DOCUMENTS

CN 1424713 A 6/2003
(Continued)

OTHER PUBLICATIONS

Written Opinion of the International Searching Authority in corresponding PCT Application No. PCT/CN2009/075273 (Mar. 4, 2010).

(Continued)

*Primary Examiner* — Susan McFadden
(74) *Attorney, Agent, or Firm* — Leydig, Voit & Mayer, Ltd.

(57) ABSTRACT

A signal classification processing method, a classification processing device, and an encoding system are provided. The signal classification processing method includes: obtaining a high band input signal; determining a signal type of the obtained high band input signal according to a time domain characteristic parameter and/or a frequency domain characteristic parameter of the high band input signal; and determining an encoding mode corresponding to the signal type. The classification processing device includes: a receiving unit, configured to obtain a high band input signal; and a processing unit, configured to determine a signal type of the obtained high band input signal according to a time domain characteristic parameter and/or a frequency domain characteristic parameter of the high band input signal and determine an encoding mode corresponding to the signal type. An encoding system is also provided. Therefore, type subdivision and processing are performed on the high band input signal, so as to facilitate encoding and decoding processing of the signal.

15 Claims, 5 Drawing Sheets

U.S. PATENT DOCUMENTS

| | | | | |
|---|---|---|---|---|
| 8,063,809 | B2 * | 11/2011 | Liu et al. | 341/155 |
| 2004/0196913 | A1 | 10/2004 | Chakravarthy et al. | |
| 2005/0075863 | A1 | 4/2005 | Jiang et al. | |
| 2006/0136211 | A1 | 6/2006 | Jiang et al. | |
| 2008/0312912 | A1 | 12/2008 | Choo et al. | |
| 2009/0222261 | A1 | 9/2009 | Jung et al. | |
| 2011/0194598 | A1 * | 8/2011 | Miao et al. | 375/240 |

FOREIGN PATENT DOCUMENTS

| | | | |
|---|---|---|---|
| CN | 101140759 | A | 3/2008 |
| CN | 101145345 | A | 3/2008 |
| WO | WO 00/19414 | A1 | 4/2000 |
| WO | WO 2007/083931 | A1 | 7/2007 |

OTHER PUBLICATIONS

International Search Report in corresponding PCT Application No. PCT/CN2009/075273 (Mar. 4, 2010).

1st Office Action in corresponding Chinese Application No. 200810187911.4 (Jan. 27, 2011).

"G.711.1—Wideband embedded extension for G.711 pulse code modulation," Series G: Transmission Systems and Media, Digital Systems and Networks, Digital terminal equipments—Coding of analogue signals by pulse code modulation, Mar. 2008, International Telecommunications Union, Geneva, Switzerland.

"G.729.1—G.729-based embedded variable bit-rate coder: An 8-32 kbit/s scalable wideband coder bitstream interoperable with G.729," Series G: Transmission Systems and Media, Digital Systems and Networks, Digital terminal equipments—Coding of analogue signals by methods other than PCM, May 2006, International Telecommunications Union, Geneva, Switzerland.

Extended European Search Report in corresponding European Application No. 09834068.0 (Oct. 21, 2011).

Bello et al., "A Tutorial on Onset Detection in Music Signals," IEEE Transactions on Speech and Audio Processing, Sep. 2005, vol. 13, No. 5, Institute of Electrical and Electronic Engineers, Valbonne, France.

* cited by examiner

SIGNAL CLASSIFICATION PROCESSING METHOD, CLASSIFICATION PROCESSING DEVICE, AND ENCODING SYSTEM

CROSS-REFERENCE TO RELATED APPLICATIONS

This application is a continuation of International Application No. PCT/CN2009/075243, filed Dec. 1, 2009, which claims priority to Chinese Patent Application No. 200810187911.4, filed Dec. 23, 2008, both of which are hereby incorporated by reference in their entireties.

FIELD OF THE INVENTION

The present invention relates to the field of voice and audio technologies, and in particular, to a signal classification processing method, a classification processing device, and an encoding system.

BACKGROUND OF THE INVENTION

In the audio and voice processing technologies, a bandwidth expansion technology emerges, that is, a frequency range of a sound signal (for example, an audio signal or a voice signal) is expanded, and mainly the bands that contain useful information or affect the sound effect are expanded. The bandwidth expansion technology has developed fast in recent years and is commercially applied in several fields, for example, to enhance the sound effect of a woofer and enhance the high frequencies of the audio and voice.

In the bandwidth expansion technology, at an encoding end, a core encoder is generally adopted to perform higher accuracy encoding on a low band input signal, and another encoder performs lower bit rate encoding on a high band input signal on which the core encoder does not perform encoding. Therefore, in many cases, the high band input signal may be regarded as a separate signal to be encoded. The process of the common bandwidth expansion method in the prior art is as follows:

The encoding end receives the high band input signal, calculates a time envelope signal and a spectral envelope signal to obtain a time envelope and a spectral envelope respectively, quantizes and muxes the time envelope and the spectral envelope, and then transmits the time envelope and spectral envelope to a decoding end. At the decoding end, the demuxed time envelope and spectral envelope are decoded, an excitation signal of a high band is generated according to parameters of the core encoder at the encoding end, and then the excitation signal is shaped by using the decoded time envelope and spectral envelope to obtain the high band output signal.

During the research and implementation of the prior art, the inventors find that the prior art has the following problems.

In the prior art, the mode for calculating and quantizing the time envelope and spectral envelope of the high band input signal is fixed, so the encoder should be set in advance to a mode applicable to a certain type of input signal, such as, a mode applicable to a voice type signal. In this case, although it is beneficial for encoding of a voice type signal, an encoding effect for an audio type signal is relatively poor. Furthermore, the types applicable in the prior art are only classification at a macroscopic level. More specific subdivided types are not distinguished in the voice type signal. For example, a transient type or a harmonic type is not considered. Therefore, better encoding cannot be performed according to further subdivided types of the input signals and better encoding effects cannot be achieved.

SUMMARY OF THE INVENTION

The embodiments of the present invention provide a signal classification processing method, a classification processing device, and an encoding system, which can better perform type subdivision and processing on a high band input signal, so as to facilitate encoding and decoding processing of the signal.

The embodiments of the present invention are implemented in the following technical solutions:

An embodiment of the present invention provides a signal classification processing method, where the signal classification processing method includes:

obtaining a high band input signal;

determining a signal type of the obtained high band input signal according to a time domain characteristic parameter and/or a frequency domain characteristic parameter of the high band input signal; and determining an encoding mode corresponding to the signal type.

An embodiment of the present invention provides a classification processing device, where the classification processing device includes:

a receiving unit, configured to obtain a high band input signal; and a processing unit, configured to determine a signal type of the obtained high band input signal according to a time domain characteristic parameter and/or a frequency domain characteristic parameter of the high band input signal and determine an encoding mode corresponding to the signal type.

An embodiment of the present invention provides an encoding system, where the encoding system includes:

a classification processing device, configured to obtain a high band input signal, determine a signal type of the high band input signal according to a time domain characteristic parameter and/or a frequency domain characteristic parameter of the high band input signal, and determine an encoding mode corresponding to the signal type; and an encoding device, configured to encode the high band input signal according to the encoding mode determined by the classification processing device.

It can be seen from the above technical solutions that, in the embodiments of the present invention, the signal type of the high band input signal is determined according to the time domain characteristic parameter and/or the frequency domain characteristic parameter of the high band input signal, and the encoding mode corresponding to the signal type is determined, thereby providing a further subdivided signal classification processing method, so type subdivision and processing are performed on the high band input signal, so as to facilitate encoding and decoding processing of the signal.

BRIEF DESCRIPTION OF THE DRAWINGS

To illustrate the technical solutions according to the embodiments of the present invention more clearly, the accompanying drawings for describing the embodiments are introduced briefly in the following. Apparently, the accompanying drawings in the following description are only some embodiments of the present invention. Persons of ordinary skill in the art can derive other drawings according to the accompanying drawings without paying any creative efforts.

DETAILED DESCRIPTION OF THE EMBODIMENTS

The technical solutions of the present invention are clearly described in the following with reference to the accompanying drawings. It is obvious that the embodiments to be described are only a part rather than all of the embodiments of the present invention. Persons of ordinary skills in the art can derive other embodiments from the embodiments given herein without making any creative effort, and all such embodiments are covered in the protection scope of the present invention.

An embodiment of the present invention provides a signal classification processing method, which can perform type subdivision on a high band input signal, so as to facilitate encoding and decoding processing of the signal.

Figure 1:
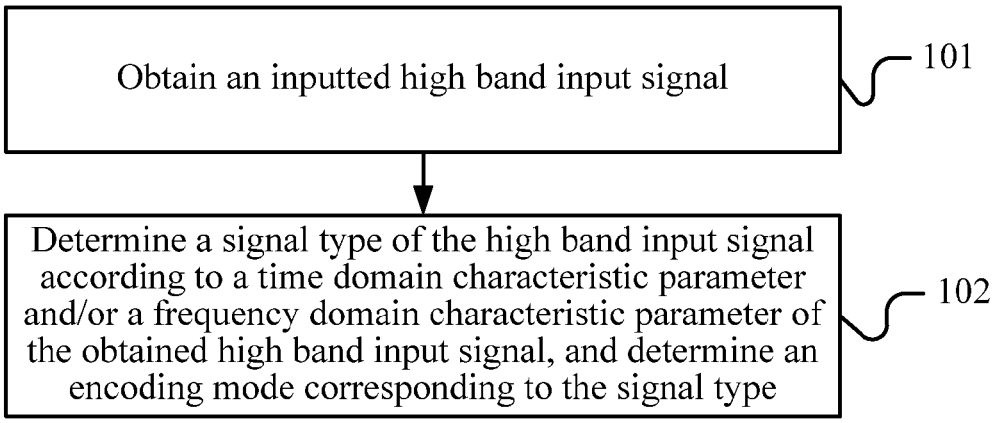
FIG. 1 is a flow chart of a method according to an embodiment of the present invention.

FIG. 1 is a flow chart of a method according to an embodiment of the present invention. As shown in FIG. 1, the method includes the following steps:

Step 101: Obtain a high band input signal.

The obtained high band input signal may be a time domain signal or a frequency domain signal.

Step 102: Determine a signal type of the high band input signal according to a time domain characteristic parameter and/or a frequency domain characteristic parameter of the obtained high band input signal, and determine an encoding mode corresponding to the signal type.

The determining the signal type of the high band input signal according to the time domain characteristic parameter of the obtained high band input signal and the determining the encoding mode corresponding to the signal type include the following steps.

A maximum envelope deviation and a maximum consecutive-envelop step value are determined according to envelope values of each of a current frame and the frames adjacent to the current frame, where the high band input signal is a time domain signal and includes a high band input signal of the current frame and a high band input signal of frames adjacent to the current frame. It is determined whether the maximum envelope deviation is greater than or equal to a maximum envelope deviation threshold, and whether the maximum consecutive-envelop step value is greater than or equal to a maximum consecutive-envelop step threshold. If it is determined that the maximum envelope deviation is greater than or equal to the maximum envelope deviation threshold and the maximum consecutive-envelop step value is greater than or equal to the maximum consecutive-envelop step threshold, it is determined that the current frame of the high band input signal is of a transient type. Alternatively, if it is determined that the maximum envelope deviation is greater than or equal to the maximum envelope deviation threshold and the maximum consecutive-envelop step value is greater than or equal to the maximum consecutive-envelop step threshold, it is further determined whether a total envelope value determined by the envelope values of each of the current frame and the frames adjacent to the current frame is greater than or equal to a total envelope threshold, and if the total envelope value is greater than or equal to the total envelope threshold, it is determined that the current frame of the high band input signal is of the transient type. It is determined that the current frame determined as the transient type corresponds to a transient type encoding mode.

Two consecutive envelope values of each frame are compared to obtain a comparison value, and a maximum comparison value is selected from comparison values as the maximum consecutive-envelop step value. An average value of the envelope values of the current frame is subtracted from the maximum envelope value to obtain a difference, which is the maximum envelope deviation. The total envelope value is a sum of envelope values or a value obtained after weighting processing of the sum of envelope values.

The determining the signal type of the high band input signal according to the time domain characteristic parameter of the obtained high band input signal and the determining the encoding mode corresponding to the signal type further include: dividing the current frame of the high band input signal into a preset number of subbands, determining whether the number of subbands having a harmonic intensity value greater than a harmonic intensity threshold is greater than or equal to a harmonic type threshold, and if the number is greater than or equal to the harmonic type threshold, determining that the current frame of the high band input signal is of a harmonic type, and determining that the current frame corresponds to a harmonic type encoding mode.

It can be seen that, in the embodiments of the invention, the signal type of the high band input signal is determined according to the time domain characteristic parameter and/or the frequency domain characteristic parameter of the high band input signal, and the encoding mode corresponding to the signal type is determined, thereby providing a further subdivided signal classification processing method, so that type subdivision and processing are performed on the high band input signal, so as to facilitate encoding and decoding processing of the signal.

The technical solutions according to an embodiment of the present invention are further described in details in the following.

Figure 2:
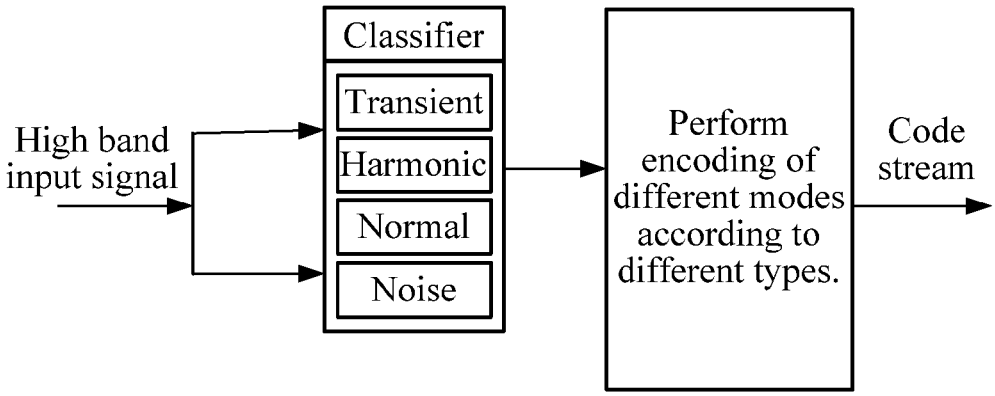
FIG. 2 is a schematic diagram of a principle structure of a method according to an embodiment of the present invention.

FIG. 2 is a schematic diagram of a principle structure of a method according to an embodiment of the present invention.

As shown in FIG. 2, high band input signals are classified into time domain input signals and frequency domain input signals, in which the frequency domain input signals are obtained by performing time frequency transformation on the time domain input signals. In other words, a time domain input signal and a frequency domain input signal obtained by a classifier are the same signal, and only presentation forms are different. Generally, high band input signals have the forms of time domain input signals. When being inputted into the classifier, the time domain input signal can be converted into the frequency domain input signal and the frequency domain input signal is inputted into the classifier. Alternatively, when the form of frequency domain signal is required, the classifier converts the time domain input signal into the frequency domain input signal to process during classification. The classifier divides the high band input signals into signals of a transient type, a harmonic type, and a normal type, or further a noise type according to a time domain characteristic parameter of the time domain input signal and a frequency domain characteristic parameter of the frequency domain input signal, determines a corresponding type encoding mode, and performs encoding processing on signals according to each type encoding mode, thereby performing encoding more precisely and more efficiently and obtaining a better encoding effect. Furthermore, the classifier may also send the classified signal types to a decoding end. The decoding end also performs processing in corresponding decoding modes, thereby accordingly obtaining a better encoding effect during encoding.

Figure 3:
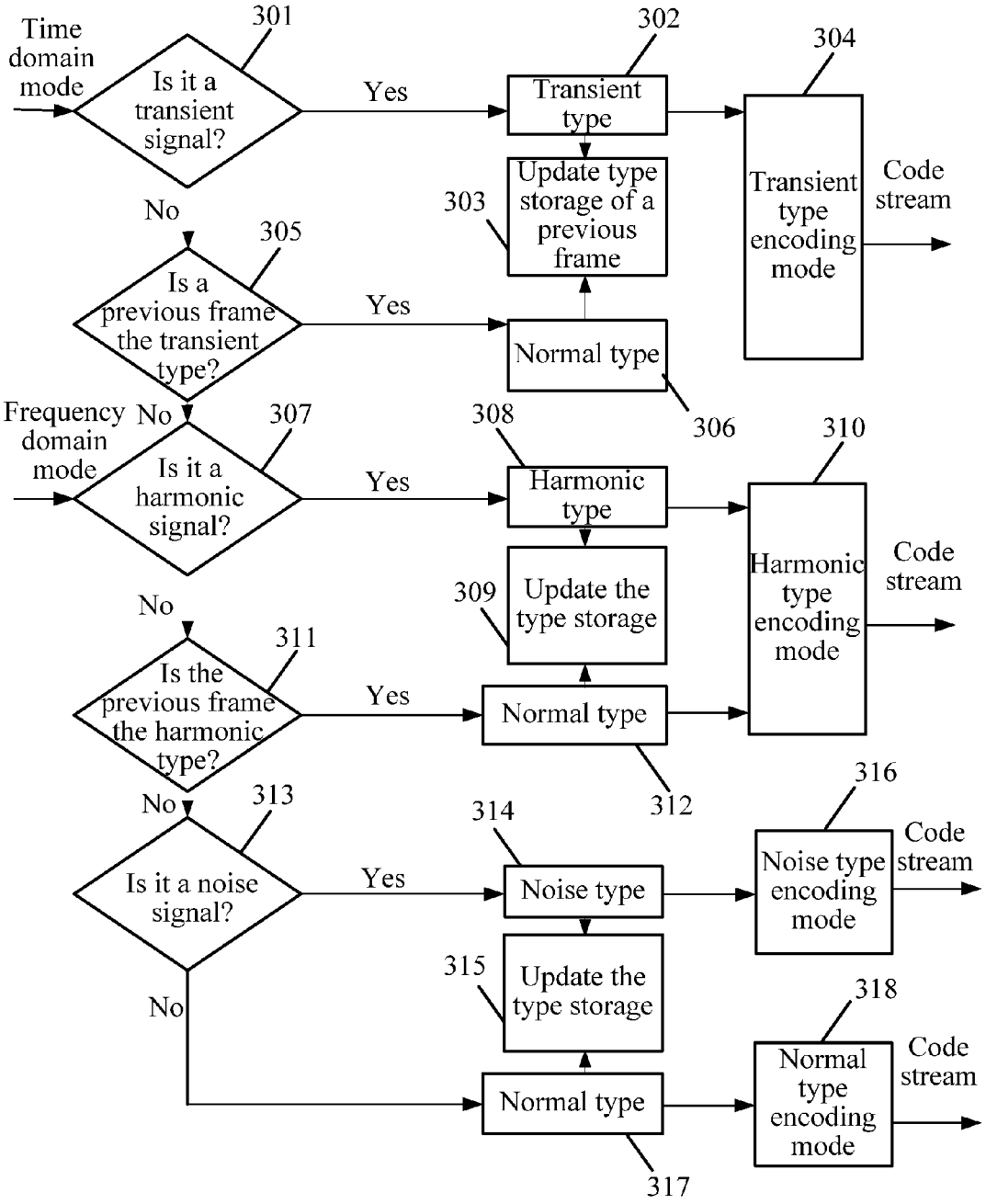
FIG. 3 is a schematic flow chart of a principle of a method according to an embodiment of the present invention.

FIG. 3 is a schematic flow chart of a principle of a method according to an embodiment of the present invention.

As shown in FIG. 3, the method includes the following steps:

Step 301: Determine whether a time domain input signal of a current frame is a transient signal. If yes, the process turns to step 302. If no, the process turns to step 305.

Step 302: Determine the transient type signal, and the process proceeds to steps 303 and 304 respectively.

Step 303: Update the signal type recorded in type storage of a previous frame.

In step 303, the update is performed according to the type determined in the step 302. If the transient type is determined in step 302, the signal type recorded in the type storage of the previous frame is updated with the transient type. If a normal type is determined in step 306 mentioned hereinafter, the signal type recorded in the type storage of the previous frame is updated with the normal type.

Step 304: Determine that a transient type encoding mode is adopted for the input signal.

Step 305: Determine whether the signal type recorded in the type storage of the previous frame is the transient type. If yes, the process proceeds to step 306. If no, the process proceeds to step 307.

Step 306: Determine the time domain input signal of the current frame as a normal type, and the process proceeds to steps 303 and 304 respectively.

In step 306, although it is determined that the signal type recorded in the type storage of the previous frame is the transient type, in order to avoid an endless loop in the process, the signal type is still determined as the normal type to update the signal type recorded in the type storage of the previous frame, but step 304 is still performed when a type encoding mode is determined, that is, it is determined that a transient type encoding mode is adopted for the input signal. In other words, the time domain input signal of the current frame may be processed according to the transient type encoding mode corresponding to the transient type.

Step 307: Determine whether a frequency domain input signal of the current frame is a harmonic type signal. If yes, the process proceeds to step 308. If no, the process proceeds to step 311.

In step 307, the frequency domain input signal of the current frame can be obtained by performing time frequency transformation on the time domain input signal of the current frame before step 307 or in step 307.

Step 308: Determine the harmonic type signal, and the process proceeds to steps 309 and 310 respectively.

Step 309: Update the signal type recorded in the type storage of the previous frame.

In this step, the updating is performed according to the type determined in the previous step of the step. If the harmonic type is determined in step 308, the signal type recorded in the type storage of the previous frame is updated with the harmonic type. If a normal type is determined in step 312 mentioned hereinafter, the signal type recorded in the type storage of the previous frame is updated with the normal type.

Step 310: Determine that a harmonic type encoding mode is adopted for the input signal.

Step 311: Determine whether the signal type recorded in the type storage of the previous frame is the harmonic type. If yes, the process proceeds to step 312. If no, the process proceeds to step 313.

Step 312: Determine the frequency domain input signal of the current frame as the normal type, and the process proceeds to steps 309 and 310 respectively.

Step 313: Determine whether the frequency domain input signal of the current frame is a noise type signal. If yes, the process proceeds to step 314. If no, the process proceeds to step 317.

Step 314: Determine the noise type signal, and the process proceeds to steps 315 and 316 respectively.

Step 315: Update the signal type recorded in the type storage of the previous frame.

In step 315, the update is performed according to the type determined in the previous step of the step. If the noise type is determined in step 314, the signal type recorded in the type storage of the previous frame is updated with the noise type. If a normal type is determined in step 317 mentioned hereinafter, the signal type recorded in the type storage of the previous frame is updated with the normal type.

Step 316: Determine that a noise type encoding mode is adopted for the input signal.

Step 317: Determine the time domain input signal of the current frame as the normal type, and the process proceeds to step 318.

All signal types that do not conform to the foregoing conditions can be defined as the normal type, that is, a default type.

Step 318: Determine that a normal type encoding mode is adopted for the input signal.

It should be noted that, in the foregoing steps, after the determination of the transient type, it is determined whether the input signal is of the harmonic type first and then whether the input signal is the noise type. But the present invention is not limited thereto. It can be determined whether the input signal is the noise type first and then whether the input signal is of the harmonic type. Furthermore, the step of determining whether the input signal is the noise type can also be excluded, that is, if it is determined that the signal type recorded in the type storage of the previous frame is not the harmonic type, the normal type is determined, and it is determined that the normal type encoding mode is adopted for the input signal.

After it is determined which type encoding mode is adopted for the input signal in the foregoing steps, an encoding process can be performed on the signal according to the type encoding mode, and the processed signal is transmitted to a decoding end. The decoding end performs decoding processing according to the corresponding type.

It can be seen that, the high band input signals are subdivided into signals of the transient type, the harmonic type, the noise type, and the normal type according to different characteristics thereof in the time domain and the frequency domain, and the encoding modes corresponding to the signal types are determined, so type subdivision and processing are performed on the high band input signal, so as to facilitate encoding and decoding processing of the signal.

Figure 4:
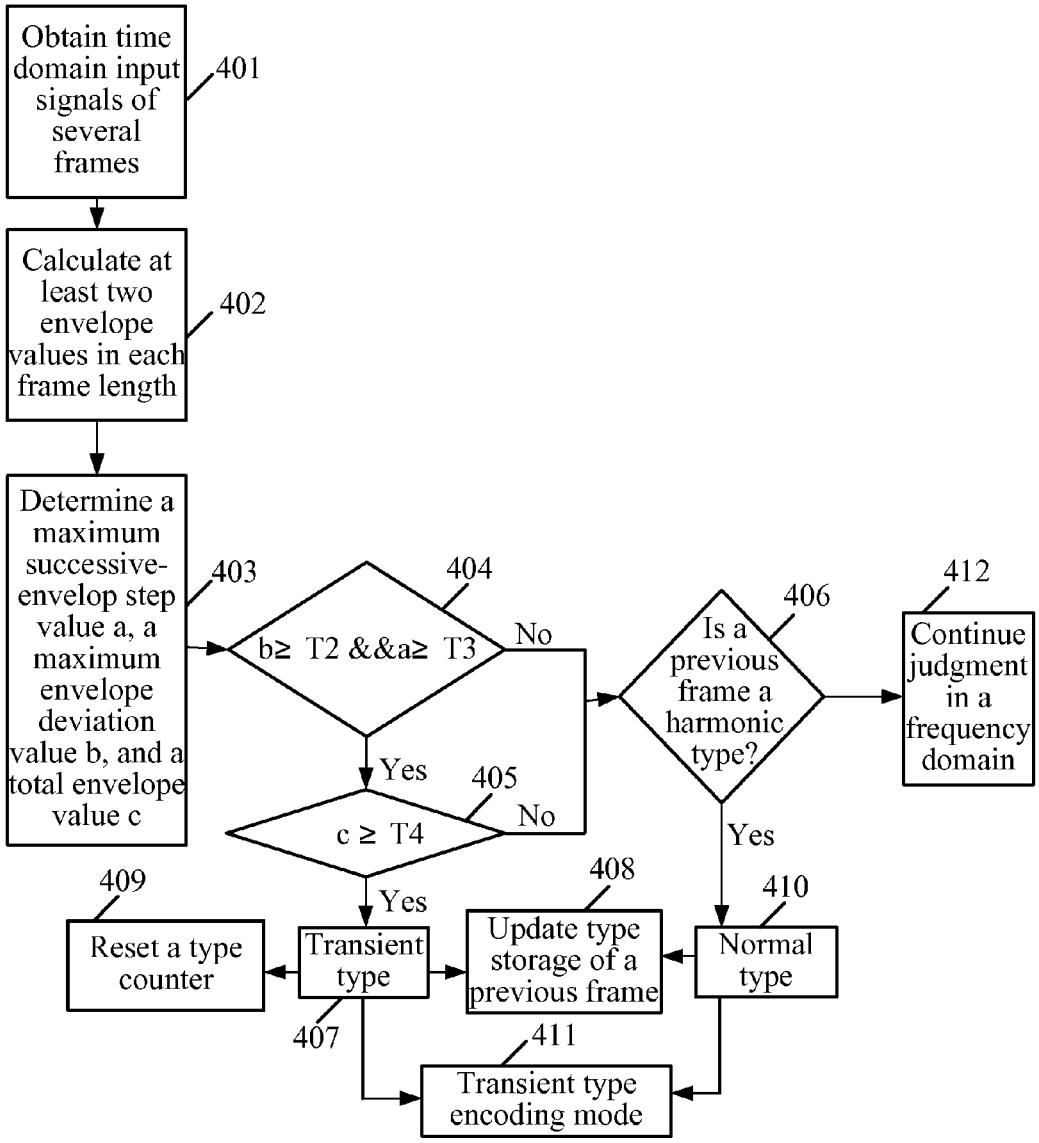
FIG. 4 is a schematic flow chart of determining a transient type in time domain in a method according to an embodiment of the present invention.

FIG. 4 is a schematic flow chart of determining a transient type in time domain in a method according to an embodiment of the present invention. As shown in FIG. 4, the method includes the following steps:

Step 401: Obtain time domain input signals of several frame lengths.

In this step, captured time domain input signals of three times of a frame length are taken as example, that is, the time domain input signals of a previous frame of a current frame, the current frame, and a next frame of the current frame are captured.

Step 402: Calculate at least two time envelope values for the time domain input signal of each frame.

In step 402, at least six envelope values are obtained.

Step 403: Determine a maximum consecutive-envelop step value a, a maximum envelope deviation b, and a total envelope value c.

The method for calculating the maximum consecutive-envelop step value a is as follows: Two consecutive envelope values of each frame are compared to obtain a comparison value, three comparison values can be obtained, and the maximum one of the three comparison values is selected as the maximum consecutive-envelop step value a.

The method for calculating the maximum envelope deviation b is as follows: An average value of the six envelope values is subtracted from the maximum envelope value to obtain a difference, and the difference is adopted as the maximum envelope deviation b.

The method for calculating the total envelope value c is as follows: The sum of the six envelope values or the value obtained by weighting the sum of the six envelope values is adopted as the total envelope value c.

Step 404: Determine whether the maximum envelope deviation b is greater than or equal to a maximum envelope deviation threshold T2 and whether the maximum consecutive-envelop step value a is greater than or equal to a maximum envelope step threshold T3. If the maximum envelope deviation b is greater than or equal to the maximum envelope deviation threshold T2 and whether the maximum consecutive-envelop step value a is greater than or equal to the maximum envelope step threshold T3, the process proceeds to step 405. If the maximum envelope deviation b is smaller than the maximum envelope deviation threshold T2 or the maximum consecutive-envelop step value a is smaller than the maximum envelope step threshold T3, it indicates that the signal is impossible to be the transient type, and the process proceeds to step 406.

The maximum envelope deviation threshold T2 and the maximum envelope step threshold T3 can generally be empirical values and set as required.

Step 405: Determine whether the total envelope value c is greater than or equal to a total envelope threshold T4. If yes, the process proceeds to step 407. If no, the process proceeds to step 406.

The total envelope threshold T4 can generally be an empirical value and set as required.

Step 406: Determine whether a signal type recorded in type storage of a previous frame is the transient type. If yes, the process proceeds to step 410. If no, the process proceeds to step 412. In Step 407, the transient type signal is determined, and the process proceeds to steps 408, 409, and 411 respectively.

Step 408: Update the signal type recorded in the type storage of the previous frame.

In step 408, the update is performed according to the type determined in the previous step of the step. If the transient type is determined in step 407, the signal type recorded in the type storage of the previous frame is updated with the transient type. If a normal type is determined in step 410 mentioned hereinafter, the signal type recorded in the type storage of the previous frame is updated with the normal type.

Step 409: Reset a type counter.

Step 410: Determine a normal type, and the process proceeds to steps 408 and 411 respectively.

Step 411: Determine that a transient type encoding mode is adopted for the input signal.

Step 412: Perform a process for determining the signal type in a frequency characteristic.

It should be noted that, the step of determining whether the total envelope value c is greater than or equal to the total envelope threshold T4 may also be excluded.

The process for determining the signal type in the frequency characteristic is referred to the following description.

It can be seen that, it can be distinguished whether the high band input signal is the transient type or the normal type according to a characteristic parameter of the time domain signal, and the encoding mode corresponding to the signal type is determined, so type subdivision and processing are performed on the high band input signal, so as to facilitate encoding and decoding processing of the signal.

Figure 5:
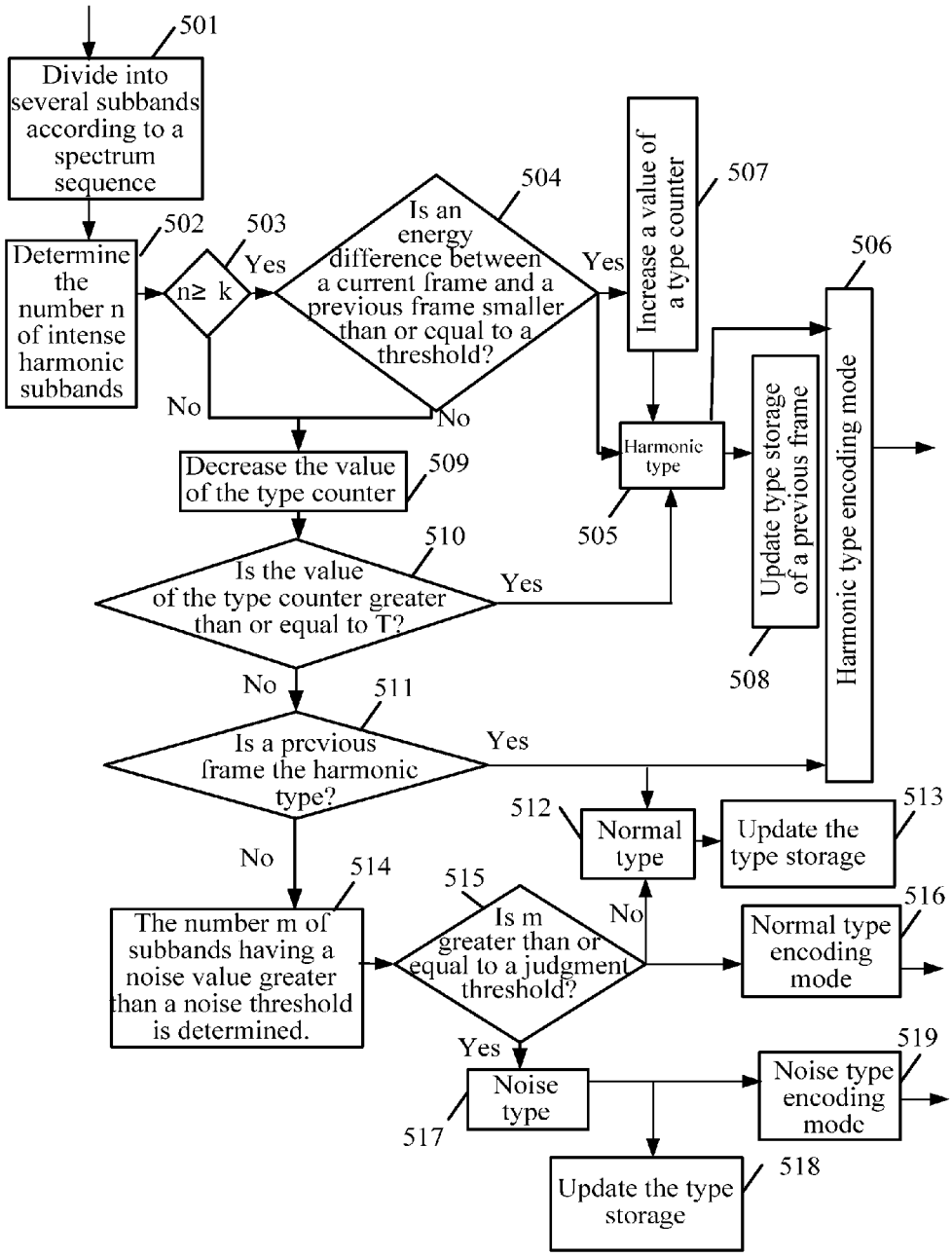
FIG. 5 is a schematic flow chart of determining a signal type in frequency domain in a method according to an embodiment of the present invention.

FIG. 5 is a schematic flow chart of determining a signal type in frequency domain in a method according to an embodiment of the present invention. As shown in FIG. 5, the method includes the following steps:

Step 501: Divide a frequency domain input signal of a current frame into several subbands according to a spectrum sequence.

Step 502: Determine the number n of intense harmonic subbands.

A harmonic intensity value of each subband is calculated. The subbands having the harmonic intensity value greater than a harmonic intensity threshold are called intense harmonic subbands. Therefore, the number n of intense harmonic subbands can be determined. The harmonic intensity value can generally be an empirical value and set as required.

Step 503: Determine whether the number n of intense harmonic subbands is greater than or equal to a harmonic type threshold K. If yes, the process proceeds to step 504. If no, the process proceeds to step 509.

The harmonic type threshold K can generally be an empirical value and set as required.

Step 504: Determine whether a difference between global spectrum energy of the current frame and global spectrum energy of the previous frame is smaller than or equal to a global spectrum energy difference threshold. If yes, the process proceeds to steps 505 and 507. If no, the process proceeds to step 509.

In step 504, the global spectrum energy difference threshold can generally be an empirical value and set as required. If the difference between the global spectrum energy of the current frame and the global spectrum energy of the previous frame is greater than the global spectrum energy difference threshold, it is determined that the spectrum energy changes too fast, so a harmonic type cannot be estimated.

Step 505: Determine a harmonic type signal, and the process proceeds to steps 506 and 508 respectively.

Step 506: Determine that a harmonic type encoding mode is adopted for the input signal.

Step 507: Increase a value of a type counter.

For example, the value of the type counter is increased by 1.

Step 508: Update the signal type recorded in type storage of a previous frame.

In step 508: Perform the update according to the type determined in the previous step of the step.

Step 509: Decrease the value of the type counter, and the process proceeds to step 5.

For example, the value of the type counter is decreased by 1.

Step 510: Determine whether the value of the type counter is greater than or equal to a set counter threshold T. If yes, the process proceeds to step 505. If no, the process proceeds to step 511.

The set counter threshold T can generally be an empirical value and set as required.

Step 511: Determine whether the signal type recorded in the type storage of the previous frame is the harmonic type. If yes, the process proceeds to steps 506 and 512 respectively. If no, the process proceeds to step 514.

Step 512: Determine a normal type signal is determined, and the process proceeds to step 513.

Step 513: Update the signal type recorded in the type storage of the previous frame.

In step 513, the update is performed according to the type determined in the previous step of the step.

Step 514: Determine a noise value of each subband, and determine the number of subbands having a noise value greater than a noise threshold m according to the comparison result between the noise value of each subband and the noise threshold.

The noise threshold can generally be an empirical value and set as required.

Step 515: Determine whether the number m is greater than or equal to a noise type threshold. If no, the process proceeds to steps 512 and 516. If no, the process proceeds to step 517.

The noise type threshold can generally be an empirical value and set as required.

Step 516: Determine that a normal type encoding mode is adopted for the input signal.

Step 517: Determine a noise type signal, and the process proceeds to steps 518 and 519 respectively.

Step 518: Update the signal type recorded in the type storage of the previous frame.

Step 519: Determine that a noise type encoding mode is adopted for the input signal.

It should be noted that, the determining process in step 504 can be excluded in the foregoing steps. In the foregoing steps, the step of determining the noise type can also be excluded. For example, if it is determined in step 503 that the number n of intense harmonic subbands is smaller than a harmonic type threshold K, it is determined that the input signal is the normal type signal and it is determined that the normal type encoding mode is adopted for the input signal. Alternatively, if it is determined in step 511 that the signal type recorded in the type storage of the previous frame is not the harmonic type, it is determined that the current frame of the high band input signal is of the normal type, the signal type recorded in the type storage of the previous frame is updated with the normal type, and it is determined that the normal type encoding mode is adopted for the input signal. Furthermore, in the foregoing steps, it can be determined whether the input signal is the noise type first and then whether the input signal is of the harmonic type. The foregoing steps can include determining the noise type and the normal type only and does not include the harmonic type.

It can be seen that, it can be distinguished whether the high band input signal is of the harmonic type, the noise type or the normal type according to a characteristic parameter of the frequency domain signal, and the encoding mode corresponding to the signal type is determined, so type subdivision and processing are performed on the high band input signal, so as to facilitate encoding and decoding processing of the signal.

The signal classification processing method according to the embodiments of the present invention is described above. A classification processing device and an encoding system according to the embodiments of the present invention are described below.

Figure 6:
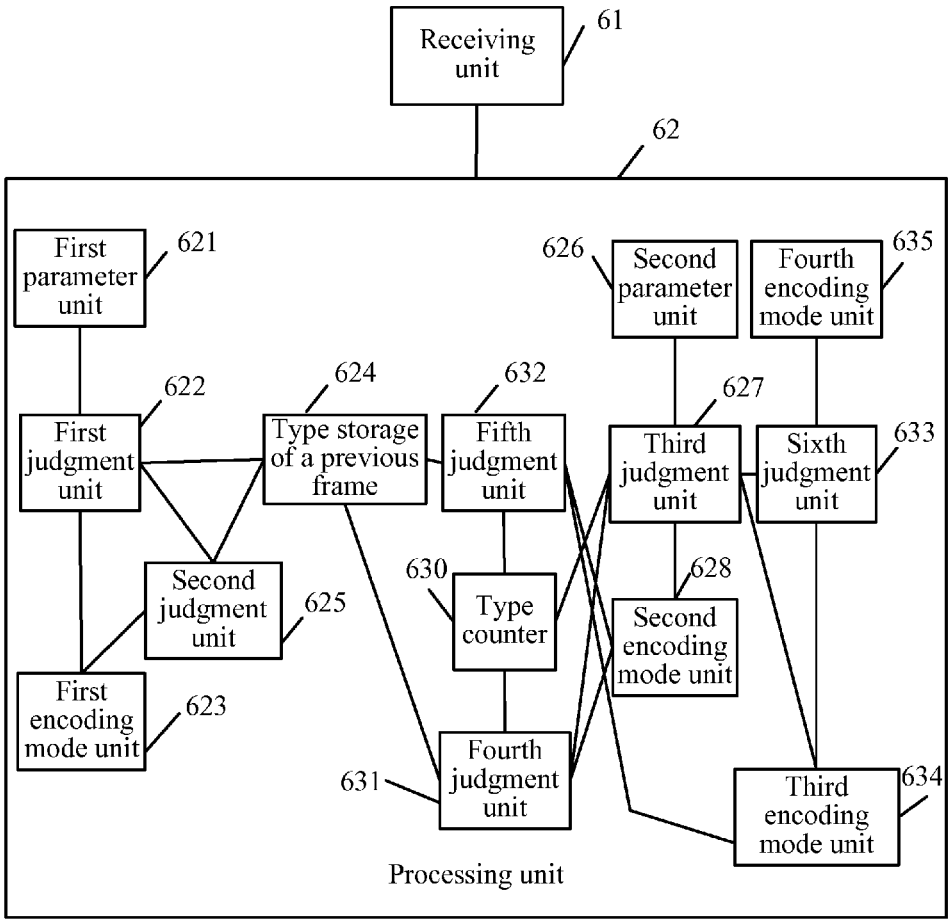
FIG. 6 is a schematic structural view of a classification processing device according to an embodiment of the present invention.

FIG. 6 is a schematic structural view of a classification processing device according to an embodiment of the present invention. As shown in FIG. 6, the classification processing device includes a receiving unit 61 and a processing unit 62.

The receiving unit 61 is configured to obtain a high band input signal.

The processing unit 62 is configured to determine a signal type of the obtained high band input signal according to a time domain characteristic parameter and/or a frequency domain characteristic parameter of the high band input signal and determine an encoding mode corresponding to the signal type.

The high band input signal obtained by the receiving unit 61 is a time domain signal and includes a high band input signal of a current frame and a high band input signal of frames adjacent to the current frame.

The processing unit 62 includes a first parameter unit 621, a first determination unit 622, and a first encoding mode unit 623.

The first parameter unit 621 is configured to determine a maximum envelope deviation and a maximum consecutive-envelop step value according to envelope values of each of the current frame and the frames adjacent to the current frame.

The first determination unit 622 is configured to determine whether the maximum envelope deviation is greater than or equal to a maximum envelope deviation threshold, and whether the maximum consecutive-envelop step value is greater than or equal to a maximum consecutive-envelop step threshold, and if it is determined that the maximum envelope deviation is greater than or equal to the maximum envelope deviation threshold and the maximum consecutive-envelop step value is greater than or equal to the maximum consecutive-envelop step threshold, determine that the current frame of the high band input signal is of a transient type.

Alternatively, if it is determined that the maximum envelope deviation is greater than or equal to the maximum envelope deviation threshold and the maximum consecutive-envelop step value is greater than or equal to the maximum consecutive-envelop step threshold, the first determination unit 622 is further configured to determine whether a total envelope value determined by the envelope values of each of the current frame and the frames adjacent to the current frame is greater than or equal to a total envelope threshold, and if yes, determine that the current frame of the high band input signal is of the transient type.

The first encoding mode unit 623 is configured to determine that the current frame determined as the transient type corresponds to a transient type encoding mode.

The processing unit 62 further includes type storage of a previous frame 624 and a second determination unit 625.

The type storage of a previous frame 624 is configured to record the signal type.

After the first determination unit 622 determines that the current frame of the high band input signal is of the transient type, the first determination unit 622 notifies the type storage of a previous frame 624 to update the recorded type to the transient type.

The second determination unit 625 is configured to check whether the type recorded in the type storage of the previous frame 624 is the transient type if it is determined by the first determination unit 622 that the maximum envelope deviation is smaller than the maximum envelope deviation threshold and the maximum consecutive-envelop step value is smaller than the maximum consecutive-envelop step threshold, or if it is further determined by the first determination unit that the total envelope value determined by the envelope values of each of the current frame and the frames adjacent to the current frame is smaller than the total envelope threshold further determined by the first determination unit, and if the recorded type is the transient type, the second determination unit 622 notifies the type storage of a previous frame 624 to update the recorded type to a normal type, but notifies the first encoding mode unit 623 to determine that the current frame corresponds to the transient type encoding mode.

The high band input signal obtained by the receiving unit 61 is also a frequency domain signal.

The processing unit 62 includes a second parameter unit 626, a third determination unit 627, a second encoding mode unit 628, and a third encoding mode unit 634.

The second parameter unit 626 is configured to divide the current frame of the high band input signal into a preset number of subbands and determine the number of subbands having a harmonic intensity value greater than a harmonic intensity threshold.

The third determination unit 627 is configured to determine whether the number of subbands having the harmonic intensity value greater than the harmonic intensity threshold is greater than or equal to a harmonic type threshold, if yes, determine that the current frame of the high band input signal is of a harmonic type, and if no, determine that the current frame of the high band input signal is of a normal type.

The second encoding mode unit 628 is configured to determine that the current frame determined as the harmonic type corresponds to a harmonic type encoding mode.

The third encoding mode unit 634 is configured to determine that the current frame determined as the normal type corresponds to a normal type encoding mode.

The processing unit 62 further includes a fourth determination unit 631.

The fourth determination unit 631 is configured to further determine whether a difference between global spectrum energy of the current frame and recorded global spectrum energy of a previous frame is smaller than or equal to a global spectrum energy difference threshold after the third determination unit 627 determines that the number of subbands having the harmonic intensity value greater than the harmonic intensity threshold is greater than or equal to the harmonic type threshold, and if the difference is smaller than or equal to the global spectrum energy difference threshold, determine that the current frame of the high band input signal is of a harmonic type.

The processing unit 62 further includes a type counter 630 and a fifth determination unit 632.

The type counter 630 is configured to record a value.

When the fourth determination unit 631 determines that the difference between the global spectrum energy of the current frame and the recorded global spectrum energy of the previous frame is smaller than or equal to the global spectrum energy difference threshold, the fourth determination unit 631 notifies the type counter 630 to increase the value, and when the fourth determination unit 631 determines that the current frame of the high band input signal is of the harmonic type, the fourth determination unit 631 notifies the type storage of a previous frame 624 to update the recorded type to the harmonic type.

When the fourth determination unit 631 determines that the difference between the global spectrum energy of the current frame and the recorded global spectrum energy of the previous frame is greater than the global spectrum energy difference threshold, or when the third determination unit 627 determines that the number of subbands having the harmonic intensity value greater than the harmonic intensity threshold is smaller than the harmonic type threshold, the type counter 630 is notified to decrease the value.

The fifth determination unit 632 is configured to determine whether the decreased value of the type counter 630 is greater than or equal to a set count threshold, if yes, determine that the current frame of the high band input signal is of the harmonic type, and if no, check whether the type recorded in the type storage of the previous frame 624 is the harmonic type, if yes, the fifth determination unit 632 notifies the type storage of a previous frame 624 to update the recorded type to the normal type, but notifies the second encoding mode unit 628 to determine that the current frame corresponds to the harmonic type encoding mode, and if no, the fifth determination unit 632 notifies the type storage of a previous frame 624 to update the recorded type to the normal type and notifies the third encoding mode unit 634 to determine that the current frame corresponds to the normal type encoding mode.

The processing unit further includes a sixth determination unit 633 and a fourth encoding mode unit 635.

The sixth determination unit 633 is configured to, when the third determination unit 627 determines that the number of subbands having the harmonic intensity value greater than the harmonic intensity threshold is smaller than the harmonic type threshold, determine that the current frame of the high band input signal is a noise type if the number of subbands having a noise value greater than a noise threshold is greater than or equal to a noise type threshold; or determine that the current frame of the high band input signal is of the normal type if the number of subbands having the noise value greater than the noise threshold is smaller than the noise type threshold, and notify the third encoding mode unit 634 to determine that the current frame corresponds to the normal type encoding mode.

The fourth encoding mode unit 635 is configured to determine that the current frame determined as the noise type corresponds to a noise type encoding mode.

Figure 7:
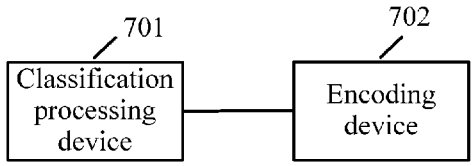
FIG. 7 is a schematic structural view of an encoding system according to an embodiment of the present invention.

FIG. 7 is a schematic structural view of an encoding system according to an embodiment of the present invention.

As shown in FIG. 7, the encoding system includes a classification processing device 701 and an encoding device 702.

The classification processing device 701 is configured to obtain a high band input signal, determine a signal type of the high band input signal according to a time domain characteristic parameter and/or a frequency domain characteristic parameter of the high band input signal, and determine an encoding mode corresponding to the signal type.

The encoding device is configured to encode the high band input signal according to the encoding mode determined by the classification processing device 701.

The classification processing device 701 has the structure as shown in FIG. 6. The classification processing device 701 includes a receiving unit and a processing unit.

First Manner

The high band input signal obtained by the receiving unit is a time domain signal and includes a high band input signal of a current frame and a high band input signal of frames adjacent to the current frame.

The processing unit includes a first parameter unit, a first determination unit, and a first encoding mode unit.

The first parameter unit is configured to determine a maximum envelope deviation and a maximum consecutive-envelop step value according to envelope values of each of the current frame and the frames adjacent to the current frame.

The first determination unit is configured to determine whether the maximum envelope deviation is greater than or equal to a maximum envelope deviation threshold, and whether the maximum consecutive-envelop step value is greater than or equal to a maximum consecutive-envelop step threshold, and if it is determined that the maximum envelope deviation is greater than or equal to the maximum envelope deviation threshold and the maximum consecutive-envelop step value is greater than or equal to the maximum consecutive-envelop step threshold, determine that the current frame of the high band input signal is of a transient type.

Alternatively, if it is determined that the maximum envelope deviation is greater than or equal to the maximum envelope deviation threshold and the maximum consecutive-envelop step value is greater than or equal to the maximum consecutive-envelop step threshold, the first determination unit is further configured to determine whether a total envelope value determined by the envelope values of each of the current frame and the frames adjacent to the current frame is greater than or equal to a total envelope threshold, and if yes, determine that the current frame of the high band input signal is of the transient type.

The first encoding mode unit is configured to determine that the current frame determined as the transient type corresponds to a transient type encoding mode.

Second Manner

The high band input signal obtained by the receiving unit is a frequency domain signal.

The processing unit includes a second parameter unit, a third determination unit, a second encoding mode unit, and a third encoding mode unit.

The second parameter unit is configured to divide a current frame of the high band input signal into a preset number of subbands and determine the number of subbands having a harmonic intensity value greater than a harmonic intensity threshold.

The third determination unit is configured to determine whether the number of subbands having the harmonic intensity value greater than the harmonic intensity threshold is greater than or equal to a harmonic type threshold, if yes, determine that the current frame of the high band input signal is of a harmonic type, and if no, determine that the current frame of the high band input signal is of a normal type.

The second encoding mode unit is configured to determine that the current frame determined as the harmonic type corresponds to a harmonic type encoding mode.

The third encoding mode unit is configured to determine that the current frame determined as the normal type corresponds to a normal type encoding mode.

Other subunits included in the classification processing device 701 are described in FIG. 6.

In conclusion, in the embodiment of the invention, the signal type of the high band input signal is determined according to the time domain characteristic parameter and/or the frequency domain characteristic parameter of the high band input signal, and the encoding mode corresponding to the signal type is determined, thereby providing a further subdivided signal classification processing method, so type subdivision and processing are performed on the high band input signal, so as to facilitate encoding and decoding processing of the signal.

Furthermore, the embodiment of the invention subdivides the high band input signal into the transient type, the harmonic type, the noise type, and the normal type and determines the encoding modes corresponding to the types.

Persons of ordinary skill in the art should understand that all or part of the steps of the method according to the embodiments may be implemented by a computer program instructing relevant hardware. The program may be stored in a computer readable storage medium. When the program is run, the steps of the method according to the embodiments are performed. The storage medium may be a magnetic disk, an optical disk, a read-only memory (ROM) or a random access memory (RAM).

The signal classification processing method, the classification processing device, and the encoding system according to the embodiments of the present invention are described in details in the foregoing. The principle and implementation of the present invention are described herein through specific examples. The description of the embodiments of the present invention is merely provided for ease of understanding of the method and core ideas of the present invention. Persons of ordinary skill in the art can make changes to the present invention in terms of the specific implementations and application scopes according to the ideas of the present invention. Therefore, the specification shall not be construed as a limit to the present invention.

What is claimed is:

1. A signal classification processing method, performed by a classification processing device, the method comprising:

obtaining a high band input signal, wherein the signal is an audio signal or a voice signal;

determining a signal type of the obtained high band input signal according to a time domain characteristic parameter of the high band input signal, and determining an encoding mode corresponding to the signal type;

wherein the high band input signal is a time domain signal and comprises a high band input signal of a current frame and a high band input signal of frames adjacent to the current frame; and the determining the signal type of the high band input signal according to the time domain characteristic parameter of the obtained high band input signal and determining the encoding mode corresponding to the signal type comprises:

determining a maximum envelope deviation and a maximum consecutive-envelop step value according to envelope values of each of the current frame and the frames adjacent to the current frame;

determining whether the maximum envelope deviation is greater than or equal to a maximum envelope deviation threshold, and whether the maximum consecutive-envelop step value is greater than or equal to a maximum consecutive-envelop step threshold, if it is determined that the maximum envelope deviation is greater than or equal to the maximum envelope deviation threshold and the maximum consecutive-envelop step value is greater than or equal to the maximum consecutive-envelop step threshold, determining whether a total envelope value determined by the envelope values of each of the current frame and the frames adjacent to the current frame is greater than or equal to a total envelope threshold, and if the total envelope value is greater than or equal to the total envelope threshold, determining that the current frame of the high band input signal is of the transient type; and determining that the current frame determined as the transient type corresponds to a transient type encoding mode.

2. The signal classification processing method according to claim 1, wherein after the determining that the current frame of the high band input signal is of the transient type, the method further comprises:

updating a recorded type to the transient type in type storage of a previous frame; and if it is determined that the maximum envelope deviation value is smaller than the maximum envelope deviation threshold or the maximum consecutive-envelop step value is smaller than the maximum consecutive-envelop step threshold; or if it is determined that the maximum envelope deviation is greater than or equal to the maximum envelope deviation threshold and the maximum consecutive-envelop step value is greater than or equal to the maximum consecutive-envelop step threshold and it is determined that the total envelope value determined by the envelope values of each of the current frame and the frames adjacent to the current frame smaller than the total envelope threshold, the method further comprises:

checking whether a recorded type in the type storage of the previous frame is the transient type, if a recorded type is the transient type, updating the recorded type to a normal type, and determining that the current frame corresponds to the transient type encoding mode.

3. The signal classification processing method according to claim 1 further comprising:

the determining the signal type of the high band input signal according to the frequency domain characteristic parameter of the obtained high band input signal and determining the encoding mode corresponding to the signal type;

wherein the determining the signal type of the high band input signal according to the frequency domain characteristic parameter of the obtained high band input signal and determining the encoding mode corresponding to the signal type comprise:

dividing the current frame of the high band input signal into a preset number of subbands, determining whether the number of subbands having a harmonic intensity value greater than a harmonic intensity threshold is greater than or equal to a harmonic type threshold, if the number is greater than or equal to the harmonic type threshold, determining that the current frame of the high band input signal is of a harmonic type, and determining that the current frame corresponds to a harmonic type encoding mode, and if the number is smaller than the harmonic type threshold, determining that the current frame of the high band input signal is of the normal type, and determining that the current frame corresponds to a normal type encoding mode, wherein the high band input signal is a frequency domain signal.

4. The signal classification processing method according to claim 3, wherein after the determining that the number of subbands having the harmonic intensity value greater than the harmonic intensity threshold is greater than or equal to the harmonic type threshold, the method further comprises:

determining whether a difference between global spectrum energy of the current frame and recorded global spectrum energy of a previous frame is smaller than or equal to a global spectrum energy difference threshold, and if the difference is smaller than or equal to the global spectrum energy difference threshold, determining that the current frame of the high band input signal is of the harmonic type.

5. The signal classification processing method according to claim 4, wherein if it is determined that the difference between the global spectrum energy of the current frame and the recorded global spectrum energy of the previous frame is smaller than or equal to the global spectrum energy difference threshold, the method further comprises: increasing a value of a type counter, and updating the recorded type in the type storage of the previous frame with the harmonic type, after the determining that the current frame of the high band input signal is of the harmonic type;

if it is determined that the difference between the global spectrum energy of the current frame and the recorded global spectrum energy of the previous frame is greater than the global spectrum energy difference threshold, or it is determined that the number of subbands having the harmonic intensity value greater than the harmonic intensity threshold is smaller than the harmonic type threshold, the method further comprises: decreasing the value of the type counter;

determining whether the decreased value is greater than or equal to a set count threshold, if the decreased value is greater than or equal to a set count threshold, determining that the current frame of the high band input signal is of the harmonic type, and if the decreased value is smaller than a set count threshold, checking whether the type recorded in the type storage of the previous frame is the harmonic type, wherein if the type is the harmonic type, the recorded type is updated with the normal type, and it is determined that the current frame corresponds to the harmonic type encoding mode, and if the type is not the harmonic type, the recorded type is updated with the normal type, it is determined that the current frame of the high band input signal is the normal type, and it is determined that the current frame corresponds to the normal type encoding mode.

6. The signal classification processing method according to claim 3, wherein when it is determined that the number of subbands having the harmonic intensity value greater than the harmonic intensity threshold is smaller than the harmonic type threshold, the method further comprises:

determining whether the number of subbands having a noise value greater than a noise threshold is greater than or equal to a noise type threshold, if the number is greater than or equal to the noise type threshold, determining that the current frame of the high band input signal is a noise type, and determining that the current frame corresponds to a noise type encoding mode;

if the number is smaller than a noise type threshold, determining that the current frame of the high band input signal is of the normal type, and determining that the current frame corresponds to the normal type encoding mode.

7. The signal classification processing method according to claim 1, further comprising:

determining the signal type of the high band input signal according to the frequency domain characteristic parameter of the obtained high band input signal and determining the encoding mode corresponding to the signal type;

wherein the determining the signal type of the high band input signal according to the frequency domain characteristic parameter of the obtained high band input signal and determining the encoding mode corresponding to the signal type comprises:

dividing the current frame of the high band input signal into a preset number of subbands, if the number of subbands having a noise value greater than a noise threshold is greater than or equal to a noise type threshold, determining that the current frame of the high band input signal is a noise type, and determining that the current frame corresponds to a noise type encoding mode, and if the number is smaller than the noise type threshold, determining that the current frame of the high band input signal is of the normal type, and determining that the current frame corresponds to the normal type encoding mode, wherein the high band input signal is a frequency domain signal.

8. A classification processing device for processing an audio signal or a voice signal, comprising:

a receiving unit, configured to obtain a high band input signal;

a processing unit, configured to determine a signal type of the obtained high band input signal according to a time domain characteristic parameter of the high band input signal, and determine an encoding mode corresponding to the signal type;

wherein the high band input signal obtained by the receiving unit is a time domain signal and comprises a high band input signal of a current frame and a high band input signal of frames adjacent to the current frame, and the processing unit comprises:

a first parameter unit, configured to determine a maximum envelope deviation and a maximum consecutive-envelop step value according to envelope values of each of the current frame and the frames adjacent to the current frame;

a first determination unit, configured to determine whether the maximum envelope deviation is greater than or equal to a maximum envelope deviation threshold, and whether the maximum consecutive-envelop step value is greater than or equal to a maximum consecutive-envelop step threshold, if it is determined that the maximum envelope deviation is greater than or equal to the maximum envelope deviation threshold and the maximum consecutive-envelop step value is greater than or equal to the maximum consecutive-envelop step threshold, determine whether a total envelope value determined by the envelope values of each of the current frame and the frames adjacent to the current frame is greater than or equal to a total envelope threshold, and if the total envelope value is greater than or equal to a total envelope threshold, determine that the current frame of the high band input signal is of the transient type; and a first encoding mode unit, configured to determine that the current frame determined as the transient type corresponds to a transient type encoding mode.

9. The classification processing device according to claim 8, wherein the processing unit further comprises:

a previous frame type storage, configured to record a signal type, after the first determination unit determines that the current frame of the high band input signal is of the transient type, the first determination unit notifies the previous frame type storage to update a recorded type to the transient type; and a second determination unit, configured to check whether the type recorded in the type storage of the previous frame is the transient type if the first determination unit determines that the maximum envelope deviation is smaller than the maximum envelope deviation threshold or the maximum consecutive-envelop step value is smaller than the maximum consecutive-envelop step threshold, or if the first determination unit determines that the total envelope value determined by the envelope values of each of the current frame and the frames adjacent to the current frame further determined by the first determination unit is smaller than the total envelope threshold, wherein if the recorded type is the transient type, the second determination unit notifies the previous frame type storage to update the recorded type to a normal type, but notifies the first encoding mode unit to determine that the current frame corresponds to the transient type encoding mode.

10. The classification processing device according to claim 8, wherein the high band input signal obtained by the receiving unit is a frequency domain signal, and the processing unit is further configured to determine a signal type of the obtained high band input signal according to a frequency domain characteristic parameter of the high band input signal, and determine an encoding mode corresponding to the signal type;

and the processing unit further comprises:

a second parameter unit, configured to divide a current frame of the high band input signal into a preset number of subbands and determine the number of subbands having a harmonic intensity value greater than a harmonic intensity threshold;

a third determination unit, configured to determine whether the number of subbands having the harmonic intensity value greater than the harmonic intensity threshold is greater than or equal to a harmonic type threshold, if the number is greater than or equal to the harmonic type threshold, determine that the current frame of the high band input signal is of a harmonic type, and if the number is smaller than the harmonic type threshold, determine that the current frame of the high band input signal is of a normal type;

a second encoding mode unit, configured to determine that the current frame determined as the harmonic type corresponds to a harmonic type encoding mode; and a third encoding mode unit, configured to determine that the current frame determined as the normal type corresponds to a normal type encoding mode.

11. The classification processing device according to claim 10, wherein the processing unit further comprises:

a fourth determination unit, configured to further determine whether a difference between global spectrum energy of the current frame and recorded global spectrum energy of a previous frame is smaller than or equal to a global spectrum energy difference threshold after the third determination unit determines that the number of subbands having the harmonic intensity value greater than the harmonic intensity threshold is greater than or equal to the harmonic type threshold, and if the difference is smaller than or equal to the global spectrum energy difference threshold, determine that the current frame of the high band input signal is of a harmonic type.

12. The classification processing device according to claim 11, wherein the processing unit further comprises:

a previous frame type storage, configured to record a signal type;

a type counter, configured to record a value;

wherein when the fourth determination unit determines that the difference between the global spectrum energy of the current frame and the recorded global spectrum energy of the previous frame is smaller than or equal to the global spectrum energy difference threshold, the fourth determination unit notifies the type counter to increase the value, and when the fourth determination unit determines that the current frame of the high band input signal is of the harmonic type, the fourth determination unit notifies the previous frame type storage to update a recorded type to the harmonic type, and when the fourth determination unit determines that the difference between the global spectrum energy of the current frame and the recorded global spectrum energy of the previous frame is greater than the global spectrum energy difference threshold, or when the third determination unit determines that the number of subbands having the harmonic intensity value greater than the harmonic intensity threshold is smaller than the harmonic type threshold, the type counter is notified to decrease the value; and a fifth determination unit, configured to determine whether the decreased value of the type counter is greater than or equal to a set count threshold, if the decreased value is greater than or equal to the set count threshold, determine that the current frame of the high band input signal is of a harmonic type, and if the decreased value is smaller than the set count threshold, check whether the type recorded in the type storage of the previous frame is the harmonic type, wherein if the type is the harmonic type, the fifth determination unit notifies the previous frame type storage to update the recorded type to the normal type, but notifies the second encoding mode unit to determine that the current frame corresponds to the harmonic type encoding mode, and if the type is not the harmonic type, the fifth determination unit notifies the previous frame type storage to update the recorded type to the normal type and notifies the third encoding mode unit to determine that the current frame corresponds to the normal type encoding mode.

13. The classification processing device according to claim 10, wherein the processing unit further comprises:

a sixth determination unit, configured to, when the third determination unit determines that the number of subbands having the harmonic intensity value greater than the harmonic intensity threshold is smaller than the harmonic type threshold, determine that the current frame of the high band input signal is a noise type if the number of subbands having a noise value greater than a noise threshold is greater than or equal to a noise type threshold; or determine that the current frame of the high band input signal is of the normal type if the number of subbands having the noise value greater than the noise threshold is smaller than the noise type threshold, and notify the third encoding mode unit to determine that the current frame corresponds to the normal type encoding mode; and a fourth encoding mode unit, configured to determine that the current frame determined as the noise type corresponds to a noise type encoding mode.

14. An encoding system, comprising:

a classification processing device, configured to obtain a high band input signal, determine a signal type of the high band input signal according to a time domain characteristic parameter of the high band input signal, and determine an encoding mode corresponding to the signal type, wherein the signal is an audio signal or a voice signal; and an encoding device, configured to encode the high band input signal according to the encoding mode determined by the classification processing device;

wherein the classification processing device comprises a receiving unit and a processing unit, the high band input signal obtained by the receiving unit is a time domain signal and comprises a high band input signal of a current frame and a high band input signal of frames adjacent to the current frame, and the processing unit comprises:

a first parameter unit, configured to determine a maximum envelope deviation and a maximum consecutive-envelop step value according to envelope values of each of the current frame and the frames adjacent to the current frame;

a first determination unit, configured to determine whether the maximum envelope deviation is greater than or equal to a maximum envelope deviation threshold, and whether the maximum consecutive-envelop step value is greater than or equal to a maximum consecutive-envelop step threshold, if it is determined that the maximum envelope deviation is greater than or equal to the maximum envelope deviation threshold and the maximum consecutive-envelop step value is greater than or equal to the maximum consecutive-envelop step threshold determine whether a total envelope value determined by the envelope values of each of the current frame and the frames adjacent to the current frame is greater than or equal to a total envelope threshold, and if the total envelope value is greater than or equal to the total envelope threshold, determine that the current frame of the high band input signal is of the transient type; and a first encoding mode unit, configured to determine that the current frame determined as the transient type corresponds to a transient type encoding mode.

15. The encoding system according to claim 14, wherein the high band input signal obtained by the receiving unit is a frequency domain signal, and the classification processing device is further configured to determine a signal type of the high band input signal according to a frequency domain characteristic parameter of the high band input signal, and determine an encoding mode corresponding to the signal type; and the processing unit further comprises:

a second parameter unit, configured to divide a current frame of the high band input signal into a preset number of subbands and determine the number of subbands having a harmonic intensity value greater than a harmonic intensity threshold;

a third determination unit, configured to determine whether the number of subbands having the harmonic intensity value greater than the harmonic intensity threshold is greater than or equal to a harmonic type threshold, if the number is greater than or equal to the harmonic type threshold, determining that the current frame of the high band input signal is of a harmonic type, and if the number is smaller than the harmonic type threshold, determine that the current frame of the high band input signal is of a normal type;

a second encoding mode unit, configured to determine that the current frame determined as the harmonic type corresponds to a harmonic type encoding mode; and a third encoding mode unit, configured to determine that the current frame determined as the normal type corresponds to a normal type encoding mode.

* * * * *